United States Patent [19]

Marass

[11] Patent Number: 4,502,678

[45] Date of Patent: Mar. 5, 1985

[54] SHEET ACCELERATING DEVICE

[75] Inventor: Josef Marass, Seehausen, Fed. Rep. of Germany

[73] Assignee: Georg Spiess GmbH, Gersthofen, Fed. Rep. of Germany

[21] Appl. No.: 347,880

[22] Filed: Feb. 11, 1982

[30] Foreign Application Priority Data

Feb. 28, 1981 [DE] Fed. Rep. of Germany ..... 3107807

[51] Int. Cl.[3] ..... B65H 5/24; B65H 5/34; B65H 5/20; B65H 9/9

[52] U.S. Cl. ..... 271/270; 271/12; 271/245; 74/69

[58] Field of Search ..... 271/270, 10, 11–15, 271/237, 245; 74/69

[56] References Cited

U.S. PATENT DOCUMENTS 2,067,513 1/1937 Talbot ..... 74/69 X 2,192,916 3/1940 Kaddeland et al. ..... 271/270 X 2,447,839 8/1948 Bingley ..... 74/69 X

*Primary Examiner*—Duane A. Reger

*Assistant Examiner*—James E Barlow

*Attorney, Agent, or Firm*—Collard, Roe & Galgano

[57] ABSTRACT

A sheet accelerating device driven by the single-revolution shaft of a feeding attachment with a front-feed unit which runs faster or slower than the single-revolution shaft is constructed in such a way that high feeding accuracy is also guaranteed at high operating speeds, and this is achieved by the provision of an intermediate gear between the advancing unit and the single-revolution shaft, the intermediate gear having a step-by-step motion gear and control gear which allows adjustment of the speed of the rotating element of the step-by-step motion gear for a part of its rotation in relation to the speed of the single-revolution shaft.

10 Claims, 2 Drawing Figures

SHEET ACCELERATING DEVICE

FIELD OF THE INVENTION

The invention relates to device for accelerating sheets aligned on the front lay marks of a feeding attachment. The sheets are fed in independent of their size in uninterrupted, overlapping succession with a processing machine provided with a front-feed device, such as a laminating machine. An advancing unit associated with the front lay marks can be operated in time with the feeding attachment, and can be driven by the single-revolution shaft of the feeding attachment together with an intermediate gear that can produce acceleration of slowing down of the single-revolution shaft for every one of the shaft's revolutions.

DESCRIPTION OF THE PRIOR ART

The disclosure DE-PS No. 1,801,634 has such an arrangement, in which the advancing device is driven by a revolving cam wheel. This can be accelerated or retarded by a differential on a part of the cam wheel's revolution in relation to the single-revolution shaft (of the feeding attachment) driving the cam wheel. Such arrangements have proved to be costly and prone to breakdown. The differential used here represents a very sensitive unit; its parts have to pass through an oil bath, thus requiring complete enclosure, which has proved to be very costly and not very easy to service. The arrangement in DE-PS No. 1,801,634 has another disadvantage: the cam wheel used here for driving the advancing device experiences unavoidable deterioration of its control characteristics, which leads to inaccuracies in feeding and to costlier maintenance and supervision. Apart from this, the machine is limited to lower speeds because at higher speeds the cam wheel's control edges would otherwise become so sharp that the contacting unit would be thrown off. The use of springs to maintain pressure attempts to prevent this happening. However, relatively costly and cumbersome arrangements are required without the danger of too high an acceleration of the contacting unit on the cam wheel being fully removed.

The disclosure DE-PS No. 1,219,951 has another sheet accelerating device. Here, driving of the accelerating unit is also accomplished by a cam wheel which can be connected to the processing machine by an electromagnetic clutch. This is cyclically closed up or lifted via the single-revolution shaft of the feeding attachment. The accelerating device is directly driven by the desired speed of the processing machine. However, activation or disengagement of the required electromagnetic clutch controlled by the single-revolution shaft of the feeding attachment requires a certain amount of time, which results from the frictional engagement of the contact surfaces of the electromagnetic clutch and the accompanying unavoidable slipping, which cannot be exactly defined. This has a negative effect on feeding accuracy. In addition, it is necessary to stop the clutch plate driven by the processing machine at each work cycle and re-accelerate it due to changes in the cycle of the advancing device, which correspond to changes in sheet size. This results in a higher mechanical stress on the surrounding machines. The disadvantages already mentioned in relation to the cam wheel also apply here.

On the basis of the above, it is thus the task of the present invention to avoid the disadvantages of the known arrangements and to produce a device such as that mentioned at the beginning. This guarantees feeding accuracy until now never imaginable; such accuracy is also possible over a long period of operation, while, at the same time, high machine speeds can be endured. The construction is nevertheless robust, simple, and requires little maintenance.

BRIEF DESCRIPTION OF THE INVENTION

The above task is accomplished according to the invention in that the intermediate gear has: a step-by-step gear connected in rotational engagement in the direction of advance with an element moving step-by-step; a rotating element coming cyclically into positive, sliding engagement with the step-by-step gear. This can itself be driven via a control gear which has two gear parts in positive, sliding engagement with each other, it being possible to adjust these together with their axes in a radial direction against each other. One of the two gear parts is in rotational engagement with the rotating element of the step-by-step gear, and the other in rotational engagement with the single-revolution shaft of the feeding attachment. One step of the step-by-step gear in the advance of the advancing mechanism corresponds at least to the distance of the front lay marks from the front-feed unit.

The mutual adjustment of the gear parts of the control gear brings about an alteration of the effective radius in the region of the mutual, positive, sliding engagement in the course of each revolution, whereby the speed of the rotating element of the step-by-step gear driven by the control gear is increased or retarded for each revolution. The period of acceleration or retardation and its occurrence in relation to the angle of rotation of the single-revolution shaft can be adjusted by the chosen degree of mutual adjustment of the gear parts of the control gear, with which exact adjustment of the desired retardation or acceleration of the advancing unit in relation to the single-revolution shaft can be effected. In the kinematic driving linkage traction here—from the single-revolution shaft to the advancing unit,—there is no frictional engagement, so that prevention of any kind of slipping is ensured. Positive engagement throughout ensures exactitude and feeding accuracy. The device according to the invention does not employ a cam wheel, so that changes in mechanical operation due to wear are not to be expected, this having a positive effect on the exactitude which can be achieved. The device according to the invention thus guarantees breakdown-free operation although with high accuracy; excellent cost-effectiveness of the whole facility can be expected.

In an advantageous embodiment of the main measures, the step-by-step gear can be constructed as a crosswheel movement. This is a robust unit with a high degree of development, and has proved reliable in use.

In a further advantageous embodiment, the gear part of the control gear on the step-by-step gear side has a running groove in a radial direction; the gear part on the single-revolution-shaft-side has a catch eccentric to its axis engaging in this groove. On the one hand, this measure guarantees simple mutual adjustment of both gear parts in a radial direction, and on the other hand, reliable mutual catching is ensured. Mutual wandering of both gear parts from the alignment of their axes is smaller than the eccentricity of the catch, so that the occurrence of jamming in the course of mutual adjustment is reliably prevented. Adjustment during the course of normal running is thus possible and operation simplified.

In another advantageous embodiment of the main measures, the gear part of the control gear on the side of the step-by-step gear can have a fixed mounting, preferably on the shaft of the rotating element of the step-by-step gear, while the gear part on the single-revolution-shaft-side can be mounted on a rotating arm about the axis of the single-revolution shaft. This advantageously allows a rigid or positively-engaging driving connection, in spite of mutual adjustability, of the control gear with the step-by-step gear on the one hand, and with the single-revolution shaft on the other.

Further embodiments according to requirements and advantageous extensions of the main measures will become apparent from the following description of a preferred embodiment taken in conjunction with the drawings and the remaining sub-claims.

DETAILED DESCRIPTION OF THE INVENTION

Figure 1:
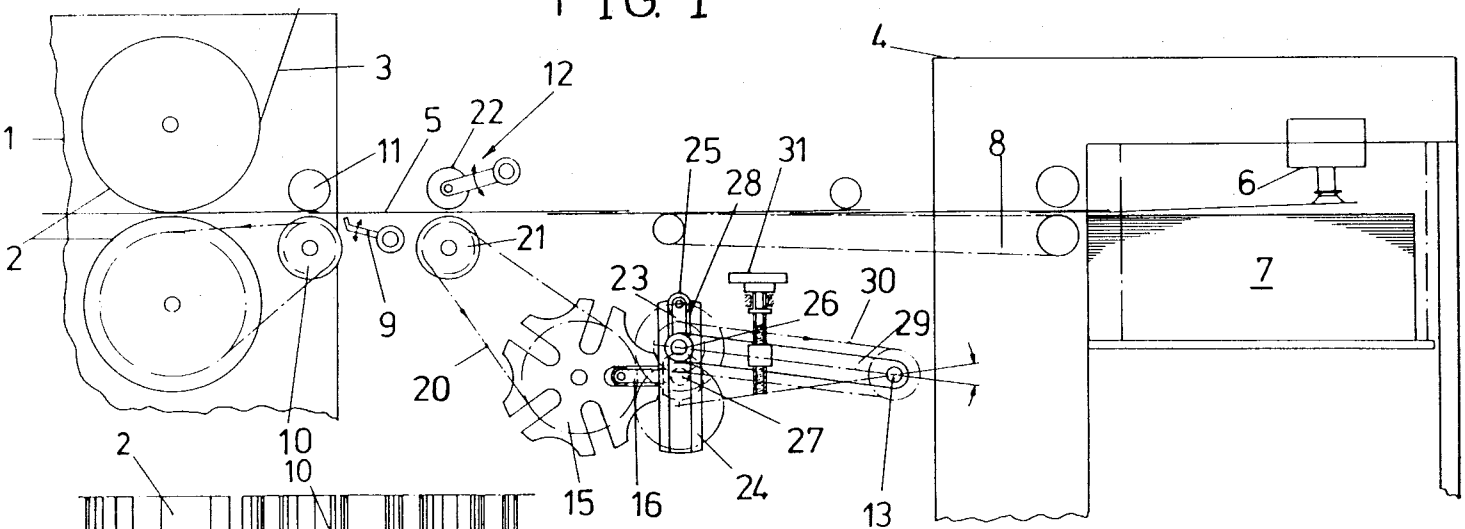
FIG. 1 shows: a preferred embodiment of the invention, with a feeding attachment as in the invention arranged in diagrammatic form in front of a laminating machine.
Figure 2:
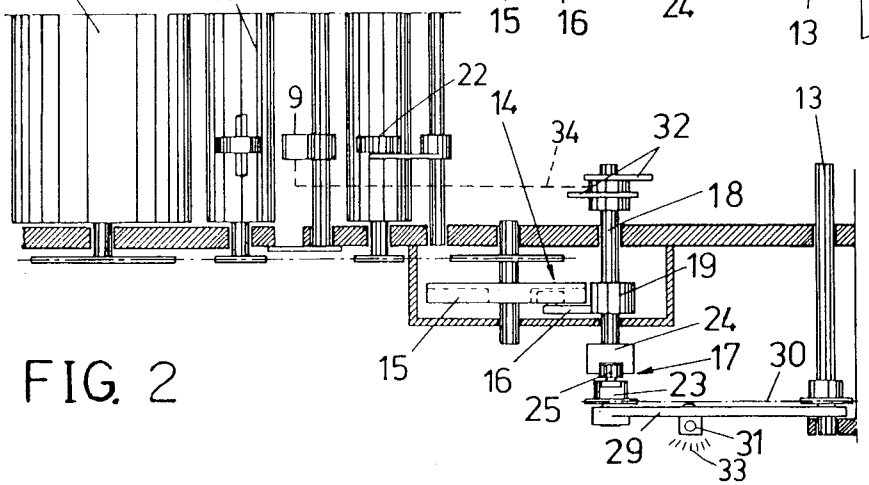
FIG. 2 shows: a diagrammatic plan view of the arrangement according to FIG. 1.

The laminating machine designated as a whole unit as 1 is provided with laminating rollers, to which a plastic sheeting web is led. This is rolled on sheets fed in in overlapping succession by a feeding attachment, designated as a whole as 4, arranged in front of the laminating machine. The laminating process is known and requires no further explanation. The feeding attachment, 4, is provided with a feeding table, (here generally represented), extending in the direction of the laminating machine. Sheets taken from a pile, 7, by a suction head, 6, pass over the table and are transported in the form of a stream of sheets by a rotating belt guide. At the front end of the feeding table, rotatively mounted lay marks are provided which intrude into the plane of motion of the sheet web, and these provide exact alignment of the oncoming sheets. The laminating machine, 1, is provided with a front-feed unit adjoining the front lay marks, 9, and this consists in the illustrated embodiment of a driven roller, 10, with attachable rollers, 11. The roller, 10, of the front-feed unit is linked to the neighbouring laminating roller, 2, by a chain drive. The sheets, 5, halted at the front lay marks, 9, are supplied to the front-feed unit of the laminating machine, 1, by an advancing unit (designated as a whole as 12), which is arranged on the feeding table of the feeding attachment, 4, in front of the lay marks, 9. During delivery of the sheets, the speed of the advancing unit, 12, corresponds exactly to the speed of the roller, 10, of the front-feed unit. Drive for the front lay marks, 9, and the advancing unit, 12, is derived from the single-revolution shaft, 13, of the feeding attachment, 4. Each complete revolution of the single-revolution shaft, 13, is accompanied by the delivery of a sheet from the feeding attachment, 4, this being independent of the size of the sheet. At each revolution of the single-revolution shaft, 13, the front lay marks, 9, and the advancing unit are correspondingly activated. Each of the sheets, 5, aligned on the front lay marks 9, has to be brought up to the adjoining front-feed unit of the laminating machine and accelerated from rest to the front-feeding speed in order to guarantee smooth-running delivery.

The laminating machine operates continuously. The laminating rollers, 2, and the roller, 10, of the front-feed unit can thus be driven at constant speed. Within a given period of time the same length of web is therefore always processed. Since per complete revolution of the single-revolution shaft, 13, a sheet is transported each time, the speed of the single-revolution shaft, 13, must be adjusted to compensate for the size of the sheet in order to ensure that the sheets are fed in without any gaps between them. For this purpose, a regulating gear is provided between the laminating machine, 1, and feeding attachment, 4. In processing small sheet sizes, the speed of the single-revolution shaft, 13, has to be increased relative to the constant speed of the laminating machine, and conversely. Since, however, the maximum speed of advance achieved by the advancing unit, 12, should remain in step with the front-feeding speed of the laminating machine, 1, the advancing unit, 12, should be speeded up or retarded in relation to the single-revolution shaft, 13, driving it according to the sheet size to be processed, so that the single-revolution shaft moves around at a different angle of rotation for every change in sheet size during the advancing phase.

To achieve this, an intermediate gear is provided between the advancing unit, 12, and the single-revolution shaft, 13, driving it in the kinematic driving linkage traction. This intermediate gear consists of a step-by-step gear, 14, with a step-by-step moving element, 15, and a rotating element, 16, coming in time in positive engagement with it. The rotating elements, 16, of the step-by-step gear, 14, is driven via an associated control gear (designated as a whole as 17), so that its speed changes in the course of a revolution, thus permitting the required retardation or acceleration of the advancing unit, 12, in relation to the single-revolution shaft, 13.

The step-by-step gear, 14, is a cross-wheel gear in the illustrated example. It consists of a cross-wheel forming the step-by-step moving element, 1 5, and is provided with radial slots and a driver which forms the rotating element, 16. The driver consists of an arm with a roller engaging in the slots of the cross-wheel. The arm is attached to a retaining segment, 19, which itself is associated with the cross-wheel and arranged on a rotatively mounted shaft, 18. The construction and mode of operation of a cross-wheel gear are in themselves known and therefore require no further explanation. At each revolution, the driver engages with a slot of the cross-wheel and turns the wheel by one step onward each time. The distance of the front lay marks, 9, from the front-feed unit, 10, of the laminating machine, 1, should be chosen to allow the distance advanced by the advancing unit, 12, which corresponds to one step of the step-by-step gear, 14, to at least match the distance of the front lay marks, 9, from the front-feed unit of the laminating machine, 1. This guarantees trouble-free sheet transfer. The highest speed reached by the cross-wheel occurs when its driver is in an extended position, which corresponds to the front-feed speed of the laminating machine. Sheet transfer takes place at this speed. The distance of the front lay marks, 9, from the front-feed unit, 10, of the laminating machine, 1, is intended to correspond at the most, and preferably exactly, to the distance moved by the advancing unit, 12, from the start of the engagement of the driver in the cross-wheel to the extended position reached by the driver,—when a cross-wheel gear is used as the step-by-step gear, 14.

The advance distance corresponding to a step is thus obtained from the distance travelled during the first half of each step. The step-by-step moving element of the cross-wheel forming the step-by-step gear, 14, is connected with the advancing unit, 12, by a chain drive, 20. The advancing unit consists in the illustrated embodiment of a driven roller with a fixed mounting, 21, and a rotatively mounted pressing roller, 22, which can be applied to the driven roller.

The control gear, 17, consists of two gear parts, 23 and 24, which are in mutual, positive and sliding engagement with each other. The gear part 23 is provided with a driver, 25, arranged eccentrically to its axis, 26. The other gear part, 24, has a running groove 28, extending in a radial direction in relation to its axis, 27, and in which the driver, 25, of the gear part, 23, engages. The axes, 26 and 27, of the gear parts, 23 and 24, are adjustable in relation to each other in a radial direction, so that the effective radius of the driver, 25, which is eccentric to its own axis, 26, changes constantly in the course of each revolution, whereby the required acceleration or retardation can be achieved. Gear part 24 with the running groove, 28, can be constructed as a rotationally symmetrical disk, 24, or, as in the illustrated embodiment, as a symmetrically formed shield, (in relation to its axis), with a traversing running groove, 28. The symmetrical form of the gear part, 24, checks unbalancing due to the forces of gravity. The gear part, 23, is constructed as a rotating, carrying arm with a roller as engaging element, the carrying arm itself being rotatable on its mounting on a carrying unit, 29, which is rotatively mounted about the axis of the single-revolution shaft, 13; the arm is in driving linkage with the single-revolution shaft, 13, via a chain drive, 30. The kinematic driving traction between the advancing unit, 12, and the single-revolution shaft 13 driving it is formed by the chain drive, 20, the step-by-step gear, 14, the control gear, 17, and the chain drive, 30, and thus has entirely positively engaging connections, so that slipping and consequent inaccuracies in relation to sheet feeding are reliably avoided.

The carrier, 29, rotatively mounted about the axis of the single-revolution shaft, 13, can be adjusted by an adjusting unit made up of an adjusting spindle, 31. As required, a scale, 33, can be affixed to the handwheel of the adjusting spindle, 31, and this would state the relation between the particular adjustment and the size of the sheets to be processed. The angle of rotation of the rotatively mounted carrier, 29, is limited to such an extent that the mutual wandering of the axes 26 and 27 of the gear parts 23 and 24 out of their alignment is smaller than the eccentricity of the driver, 25, in relation to its axis, 26. Thus, the driver, 25, can never pass through the center of the gear part, 24, which prevents blocking. The upper and lower final positions of the pivotable carrier, 29, with the gear part, 23, mounted on it, are shown in FIG. 1.

Operation of the front lay marks, 9, and the pressing rollers, 22, can be effected by operating magnets controlled by a relay operated itself by the shaft, 18. In the illustrated embodiment, cam disks, 32, are arranged on the shaft of the rotating element, 16, of the step-by-step gear, 14, for operating the front lay marks, 9, and the pressing rollers, 22, of the advancing unit, 12, and these function via rods schematically represented by reference numeral 34, (here not more exactly described), in conjunction with the front lay marks and pressing rollers, 22. In this way it is ensured that the front lay marks, 9, and the pressing rolles are automatically activated in time by the feeding attachment, 4. The basis of FIG. 1 is an operational situation in which the front-feed unit of the laminating machine 1, has just taken hold of a sheet. In the illustrated embodiment, the sheets are not laid end to end but with slight overlapping, which is cut away when the laminated web is separated into sheets. As soon as the sheet, 5, has been caught by the front-feed unit, the pressing rollers, 22, of the advancing unit, 12, disengage with the associated advancing roller, 21. In FIG. 1, the disengaged position has already been reached. At the same time or shortly afterwards, the front lay marks, 9, can be swung upwards after having been swung downwards, so that they again intrude into the plane of movement of the sheet web, and the next sheet can approach with its front edge and be aligned. This sheet remains so long in position until its front edge is released by the front lay marks, 9, and the advancing unit, 12, is activated. Before the front lay marks, 9, are swung downwards and the waiting sheet released, the pressing rollers, 22, are let down on the associated advancing roller, 21, so that the sheet alignment remains. This can be easily achieved by corresponding arrangement and construction of the control disks, 32. In this sheet take-up position, the advancing unit, 12, remains in place until it is activated by the step-by-step gear, 14. After transfer of the sheet the pressing rollers, 22, are swung away from the roller 21. Then the front lay marks are swung upwards again and the process is repeated.

The above describes an especially preferred embodiment of the invention; this does not, however, assume any limitations. Instead, a series of possibilities are at the disposal of those skilled in the art, so that they can use the basic concepts of the invention's solution and adapt them to particular situations.

I claim:

1. A device for accelerating sheets aligned on front lay marks of a feeding attachment, the sheets being fed independent of their size, in uninterrupted, overlapping succession with a processing machine or similar device, whereby an advancing unit associated with the front lay marks is operated in timed relation with the feeding attachment, and is driven by a single-revolution shaft of the feeding attachment together with an intermediate gear that produces acceleration or slowing down of the feeding attachment in respect of the single-revolution shaft for every one of the shaft's revolutions, wherein the intermediate gear has a step-by-step motion gear with a step-by-step moving element connected in rotational engagement with the advancing unit, and a rotating element coming cyclically into positive, sliding engagement with the step-by-step moving element, which itself is driven via a control gear that has two gear parts adjustable, together with their axes, in a radial direction in relation to each other and found in positive engagement with each other and, of which, one part is in rotational engagement with the rotating element of the step-by-step motion gear and the other in rotational engagement with the single-revolution shaft of the feeding attachment; and wherein the distance advanced by the advancing unit, which corresponds to one step of the step-by-step motion gear, at least corresponds to the distance between the front lay marks and the front-feed unit of the processing machine.

2. A device according to claim 1, wherein a cross-wheel gear is used as the step-by-step motion gear.

3. A device according to claim 1, wherein the gear part on the step-by-step motion gear side of the control gear has a running groove extending in a radial direction, and the gear part on the single-revolution shaft side has a driver eccentrically positioned in relation to its axis engaging in the running groove.

4. A device according to claim 3, wherein the mutual wandering of the gear parts from the alignment of their axes is smaller than the eccentricity of the driver in relation to its axis.

5. A device according to claim 3, wherein the gear part with the running groove is mounted at its central axis.

6. A device according to claim 1, wherein the gear part on the step-by-step motion gear side of the control gear is arranged in a fixed position on the shaft of the rotating element of the step-by-step motion gear.

7. A device according to claim 1, wherein the gear part on the single-revolution shaft side of the control gear is mounted on a carrier which is pivotable about the axis of the single-revolution shaft.

8. A device according to claim 7, wherein the rotatively mounted carrier can be pivoted by means of an adjusting unit provided with an adjusting scale.

9. A device according to claim 1, wherein cam disks are arranged on the shaft of the rotating element of the step-by-step motion gear for operating the front lay marks and for effecting the take-up of a sheet in the front-feed device by means of an advancing unit which cooperates with said cam disks.

10. A device according to claim 9, wherein the cam disks are arranged and constructed in such a way that the advancing unit constructed as peripherally driven rollers with pressing rollers adjustable for pressure and release, is brought into the sheet take-up position before the front lay marks move out of sheet take-up and before the advancing unit itself is activated via the step-by-step motion gear.

* * * * *